US008897663B2

(12) United States Patent
Yamaguchi et al.

(10) Patent No.: US 8,897,663 B2
(45) Date of Patent: Nov. 25, 2014

(54) INDUCTION HEATING DEVICE AND IMAGE FORMING APPARATUS

(75) Inventors: Atsushi Yamaguchi, Tahara (JP); Seiichi Kirikubo, Toyohashi (JP); Yutaka Yamamoto, Shinshiro (JP); Takahiro Tsujimoto, Toyokawa (JP); Hiroyuki Watanabe, Toyokawa (JP); Hidenori Mine, Toyohashi (JP); Masato Ishii, Toyokawa (JP)

(73) Assignee: Konica Minolta, Inc., Chiyoda-Ku, Tokyo (JP)

( * ) Notice: Subject to any disclaimer, the term of this patent is extended or adjusted under 35 U.S.C. 154(b) by 129 days.

(21) Appl. No.: 13/457,193

(22) Filed: Apr. 26, 2012

(65) Prior Publication Data

US 2012/0275810 A1 Nov. 1, 2012

(30) Foreign Application Priority Data

Apr. 27, 2011 (JP) ..... 2011-100239

(51) Int. Cl.
*G03G 15/20* (2006.01)
*H05B 6/14* (2006.01)

(52) U.S. Cl.
CPC ..... *G03G 15/2039* (2013.01); *H05B 6/145* (2013.01)
USPC ..... 399/88; 399/37; 399/67

(58) Field of Classification Search
CPC ... G06G 15/20; G06G 15/80; G06G 15/2039; G06G 2215/00978
USPC ..... 399/88, 67, 69, 37, 320; 219/216, 635; 315/291
See application file for complete search history.

(56) References Cited

U.S. PATENT DOCUMENTS

| | | | | |
|---|---|---|---|---|
| 7,277,651 | B2 | 10/2007 | Hanamoto et al. | |
| 2004/0183477 | A1* | 9/2004 | Newman et al. | 315/291 |
| 2010/0110739 | A1 | 5/2010 | Nishikawa | |
| 2010/0119248 | A1 | 5/2010 | Ishikawa | |
| 2011/0280597 | A1* | 11/2011 | Shimura et al. | 399/37 |

FOREIGN PATENT DOCUMENTS

CN 101738915 6/2010

(Continued)

OTHER PUBLICATIONS

Machine translation of JP 2005-333737 printed on Nov. 18, 2013.*

(Continued)

*Primary Examiner* — Sophia S Chen
(74) *Attorney, Agent, or Firm* — Buchanan Ingersoll & Rooney PC

(57) ABSTRACT

An induction heating device including a coil which inductively heats a workpiece of a fuser with an input voltage obtained from an alternating current voltage by rectification; a switching element coupled in series with the coil; a peak voltage detector which detects a peak value of the input voltage; an effective voltage detector which detects an effective value of the input voltage; a crest factor calculator which calculates an actual crest factor of the input voltage based on the peak value of the input voltage and the effective value of the input voltage; and a power controller which achieves control of power to the fuser by controlling the duty ratio of ON and OFF periods of the switching element.

8 Claims, 12 Drawing Sheets

(56) References Cited

FOREIGN PATENT DOCUMENTS

| | | |
|---|---|---|
| CN | 101741234 | 6/2010 |
| JP | 1-186781 | 7/1989 |
| JP | 9-201043 | 7/1997 |
| JP | 2003-98860 | 4/2003 |
| JP | 2005-333737 | 12/2005 |
| JP | 2006-244824 | 9/2006 |
| JP | 2007-133292 | 5/2007 |
| JP | 2008-33014 | 2/2008 |

OTHER PUBLICATIONS

Machine translation of JP 2006-244824 printed on Nov. 18, 2013.*
Notification of Allowance mailed Aug. 27, 2013, directed to JP Application No. 2011-100239; 6 pages.
Notification of Reasons for Refusal mailed May 28, 2013, directed to Japanese Application No. 2011-100239; 4 pages.
Official Action issued in corresponding Chinese Patent Application No. 201210123950.4, dated Jan. 6, 2014, and English translation (14 pages).

* cited by examiner

INDUCTION HEATING DEVICE AND IMAGE FORMING APPARATUS

This application claims priority under 35 U.S.C. §119 to Japanese Patent Application No. 2011-100239 filed on Apr. 27, 2011, the entire disclosure of which is incorporated herein by reference in its entirety.

BACKGROUND OF THE INVENTION

1. Field of the Invention

The present invention relates to: an induction heating device serving to apply heat to a heating element of a fuser installed on an image forming apparatus; and an image forming apparatus with this induction heating device being installed thereon.

2. Description of the Related Art

The following description sets forth the inventor's knowledge of related art and problems therein and should not be construed as an admission of knowledge in the prior art.

Some of the image forming apparatuses such as copiers, printers, and facsimiles and the multifunctional digital image forming apparatuses called as MFPs (Multi Function Peripherals), collectively having the functions of these image forming apparatuses, have an induction heating device as a source of heat for heating a heating element of the fuser.

Such an induction heating device conventionally has employed a method of achieving control of power to a heating element of the fuser: performing full-wave rectification to convert a commercial AC voltage to DC and applying it to the induction heating device; and controlling the ON/OFF state of a switching element constituting an IGBT (Insulated Gate Bipolar Transistor) for example, coupled in series with an induction heating coil.

Such an induction heating device is configured to achieve control of power to a heating element of the fuser by the changing the duty ratio of ON and OFF periods of the switching element, more specifically by changing the duty ratio based on a peak value of the input voltage and an value of power needed to heat the heating element to a certain temperature (for example, Japanese Unexamined Patent Publication No. 2003-098860).

Sometimes the voltage of an input commercial alternating current (provided at a frequency of either 50 Hz or 60 Hz) changes while the induction heating device is heating the heating element, and if the input voltage has a high peak value, the switching element, which turns the induction heating coil ON and OFF, can be broken down because of too much input voltage.

A distortion of an input voltage waveform also affects the input power greatly. A distortion of an input voltage waveform is a phenomenon caused by the deterioration of a power generator, which can be commonly found in developing regions of the world. When the input voltage shows a distorted wave, the relationship between the actual effective input voltage Vrms and the peak voltage Vp cannot be expressed by the following formula: $Vrms=Vp/\sqrt{2}$, which represents a normal sine wave.

Losing accuracy in controlling the input power when there is a distortion in an input voltage waveform as described above, has been a problem with such a conventional induction heating device configured to achieve control of the input power by changing the duty ratio of ON and OFF periods of the switching element.

The description herein of advantages and disadvantages of various features, embodiments, methods, and apparatus disclosed in other publications is in no way intended to limit the present invention. Indeed, certain features of the invention may be capable of overcoming certain disadvantages, while still retaining some or all of the features, embodiments, methods, and apparatus disclosed therein.

SUMMARY OF THE INVENTION

A first aspect of the present invention relates to an induction heating device comprising:

a coil which inductively heats a workpiece of a fuser with an input voltage obtained from an alternating current voltage by rectification;

a switching element coupled in series with the coil;

a peak voltage detector which detects a peak value of the input voltage;

an effective voltage detector which detects an effective value of the input voltage;

a crest factor calculator which calculates an actual crest factor of the input voltage based on the peak value of the input voltage which is detected by the peak voltage detector and the effective value of the input voltage which is detected by the effective voltage detector; and a power controller which achieves control of power to the fuser by controlling the duty ratio of ON and OFF periods of the switching element, wherein the power controller is characterized by calculating a duty ratio of ON and OFF periods of the switching element based on: a value of power needed to supply the fuser; the effective value of the input voltage which is detected by the effective voltage detector; the crest factor for a sine-wave input voltage; and the actual crest factor of the input voltage which is calculated by the crest factor calculator.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Hereinafter, a mode of implementing the present invention will be described with reference to the accompanying drawings.

Figure 1:
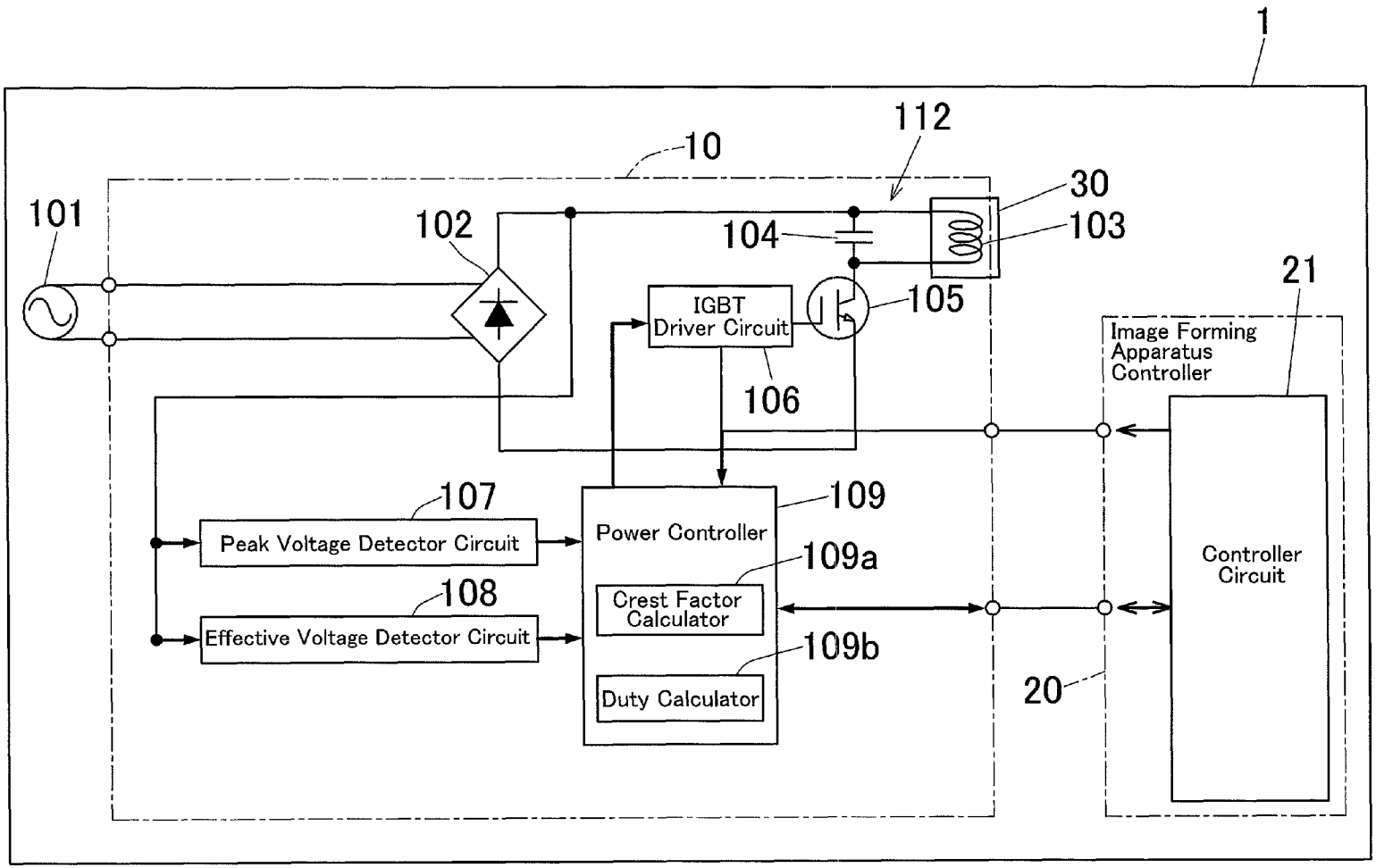
FIG. 1 is a block diagram illustrating a configuration of an image forming apparatus according to one mode of implementing the present invention.

FIG. 1 is a block diagram illustrating a configuration of an image processing apparatus according to one mode of implementing the present invention.

An image forming apparatus 1 is provided with: an induction heating device 10, an image forming apparatus controller 20, and a fuser 30.

The induction heating device 10 is provided with: a full-wave rectifier circuit 102, an induction heating coil (inductor) 103, an capacitor 104, a switching element 105, an IGBT driver circuit 106, a peak voltage detector circuit 107, an effective voltage detector circuit 108, and a power controller 109.

The full-wave rectifier circuit 102 serves to convert to direct current, an alternating current from a commercial power supply 101 which provides an alternating current of 100V at a frequency of either 50 Hz or 60 Hz, by performing full-wave rectification.

Receiving the output of the full-wave rectifier circuit 102 as an input voltage, the coil 103 inductively applies heat to a heating element (not illustrated in the figures) of the fuser 30, which is magnetically coupled with the coil 103 itself.

The capacitor 104, which is coupled in parallel with the coil 103, forms a resonant circuit 112 jointly with the coil 103.

The switching element 105, which is coupled in series with the coil 103, forms a closed loop extending from the commercial power supply 101 through the full-wave rectifier circuit 102, the resonant circuit 112, the switching element 105, and the same full-wave rectifier circuit 102 again, then returning to the same commercial power supply 101. The switching element 105 is not limited to any particular types; for the sake of expedience, an Insulated Gate Bipolar Transistor (IGBT) is employed as the switching element 105 in this mode of implementation.

The IGBT driver circuit 106 drives the switching element 105 at high frequencies, by turning the switching element ON and OFF according to instructions form the power controller 109.

Figure 2A:
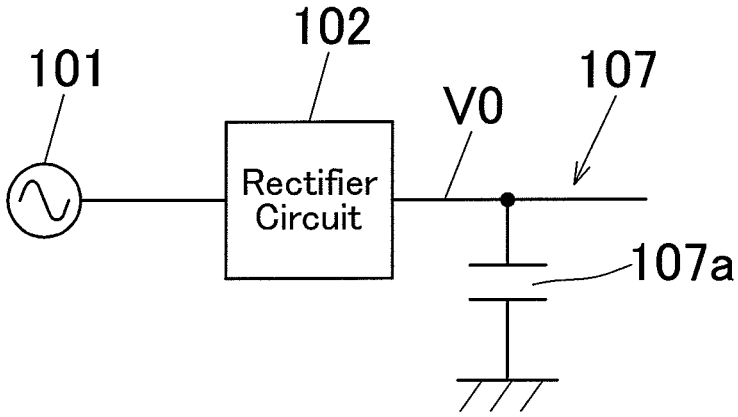
FIG. 2A is a circuit diagram illustrating an example of a peak voltage detector circuit.
Figure 2B:
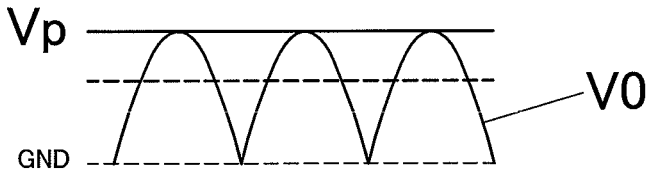
FIG. 2B is a waveform chart indicating the input voltage.

The peak voltage detector circuit 107 detects a peak value Vp of the input voltage V0 which is provided to the coil 103 by the full-wave rectifier circuit 102. The peak voltage detector circuit 107 includes a capacitor 107*a* to be charged with the input voltage V0 for example as illustrated in FIG. 2A, and the capacitor 107*a* can be charged up to a peak value (also referred to as peak voltage) Vp of the input voltage V0. Thus the peak voltage detector circuit 107 is allowed to detect a peak voltage Vp by detecting the maximum value of a charging voltage. Actually, the peak voltage detector circuit 107 further includes a circuit to convert or divide the peak voltage Vp to obtain a reasonable value of the input voltage V0, because the peak voltage Vp is usually too high for practical use.

Figure 3:
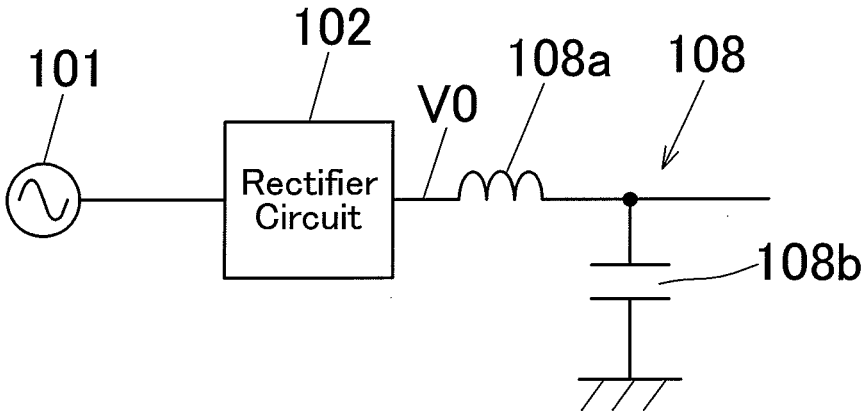
FIG. 3 is a circuit diagram illustrating an example of an effective voltage detector circuit.
Figure 4A:
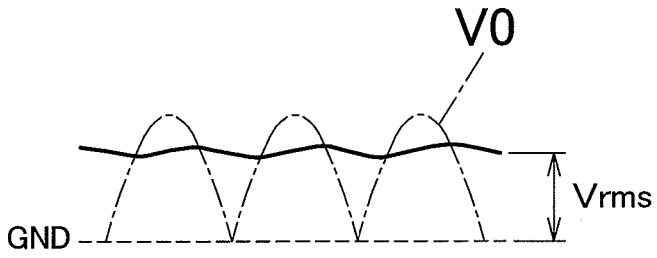
FIG. 4 is a waveform chart indicating the effective voltage detected by the effective voltage detector circuit.
Figure 4B:
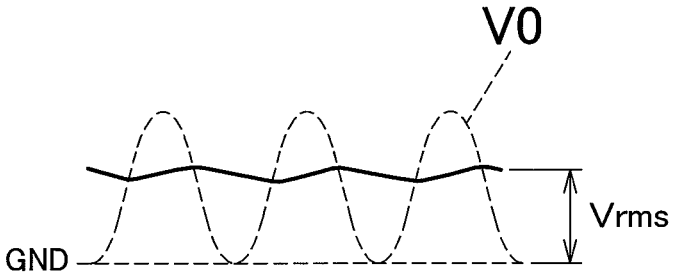

The effective voltage detector circuit 108 detects an effective value (also referred to as effective voltage) Vrms of the input voltage V0. The effective voltage detector circuit 108 is comprised of a choke-input-type rectifier which is provided with: a choke coil 108*a* coupled in series with the full-wave rectifier circuit 102; and a capacitor 108*b* to be charged with the output of the choke coil 108*a*, for example as illustrated in FIG. 3. Thus the effective voltage detector circuit 108 is allowed to detect an effective voltage Vrms from the output of the capacitor 108*b* properly even if the input voltage V0 shows a sine wave as indicated by an alternating long and short dashed line in FIG. 4A or a distorted wave indicated by a normal dashed line in FIG. 4B. It should be better to perform averaging on the input voltage V0 in order to use it as a detected voltage for example using the AD port of a CPU, because the capacitor 108*b* usually produces a ripple output.

The power controller 109, which includes a CPU, a ROM, a RAM, and the like not illustrated in these Figures, is configured to achieve control of power to a heating element of the fuser 30 by making the IGBT driver circuit 106 turn the switching element 105 between ON and OFF.

It is not preferred that the power controller 109 loses accuracy, when the input voltage V0 shows a distorted wave, in controlling the input power by changing the duty ratio of a drive signal for the switching element 105 based on an effective value Vrms1 which can be calculated using the following formula: $Vrms1=Vp/\sqrt{2}$, which contains a peak value Vp detected by the peak voltage detector circuit 107, because the effective value Vrms1 is usually more than a little different from an actual effective value Vrms2 in that case.

To solve this problem, in this mode of implementation, the power controller 109 further includes a crest factor calculator 109*a* and a duty calculator 109*b* which are fully functional.

The crest factor calculator 109*a* calculates a crest factor CF using the following formula: CF=Vp/Vrms, which contains a peak value Vp of the input voltage V0 which is detected by the peak voltage detector circuit 107 and an effective value Vrms of the input voltage V0 which is detected by the effective voltage detector circuit 108.

The duty calculator 109*b* calculates a pulse width of a drive signal controlling the ON and OFF periods of the switching element 105, based on: a crest factor calculated by the crest factor calculator 109*a*; an effective value Vrms of the input voltage V0; and a value of power needed to supply a heating element of the fuser 30 which is received from the image forming apparatus controller 20, and then arrives at a duty ratio. This will be further described in detail later. Subsequently the power controller 109 makes the IGBT drive circuit 106 drive the switching element 105 at the duty ratio obtained by the duty calculator 109*b*.

A controller circuit 21 of the image forming apparatus controller 20, which includes a CPU, a ROM, a RAM, and the like not illustrated in these Figures, instructs the power controller 109 to start to supply the fuser 30 with power and determine a value of power needed to supply.

Hereinafter, a method for calculating a pulse width (duty ratio) of a drive signal for the switching element 105, according to this mode of implementation, will be described.

Figure 5:
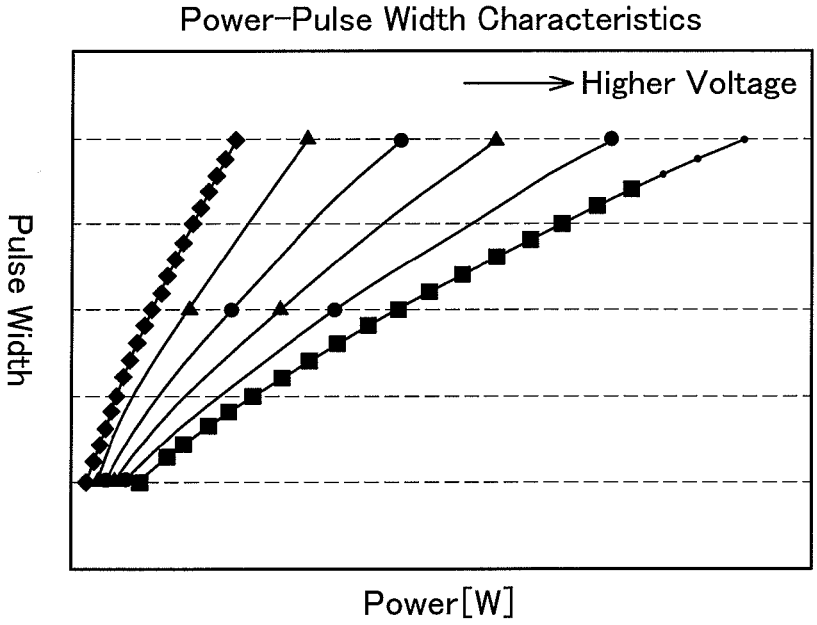
FIG. 5 is a view illustrating the relationship between the power to a fuser and the pulse width of a drive signal for a switching element.

FIG. 5 is a chart showing the relationship between the value of power needed to supply the fuser 30 and the pulse width of a drive signal for the switching element 105, which are both actually measured; and the chart has the value of power on the horizontal axis and the pulse width on the vertical axis. There are a plurality of characteristic lines in this chart because the relationship between the necessary value of power and the pulse width is usually different depending on the amount (effective value) of the input voltage V0 given to the coil 103.

As is obviously understood from this chart, the value of power needed to supply the fuser 30 is approximately proportional to the pulse width for a drive signal. Also as is obviously understood from this chart, the higher the effective value of the input voltage V0 becomes, the higher value of power can be supplied, even under the same pulse width.

Assuming the characteristic lines in the chart of FIG. 5 to be straight, the relationship between the pulse width PW and the necessary value of power P1 can be expressed by the following linear formula: $PW=A\times(P1)^2+B\times P1$ (the symbols A and B are constant values), or can be approximated by the following linear-quadratic formula: $PW=A\times W^2+B\times W+C$ (the symbols A, B, and C are constant values).

Each of the characteristic lines in the chart depends on the effective value Vrms of the input voltage V0, and the symbols A, B, and C in the above-introduced linear formulas can be expressed using the following formulas: $A=\alpha\times Vrms+\alpha'$ (the symbols $\alpha$ and $\alpha'$ are constant values); $B=\beta\times Vrms+\beta'$ (the symbols $\beta$ and $\beta'$ are constant values); and $C=\gamma\times Vrms+\gamma'$ (the symbols $\gamma$ and $\gamma'$ are constant values), respectively.

Conventionally, an effective value of the input voltage V0 has been calculated by the following formula: $Vrms=Vp/\sqrt{2}$, which contains a peak value Vp of the input voltage V0. And thus, when the input voltage V0 shows a distorted wave, an effective value of the input voltage V0 which is calculated by the above formula is usually more than a little different from an actual effective value, which has hindered accurate control of the input power.

What is more, when the peak value Vp becomes higher with the distortion of the input voltage V0, the switching element 105 can be broken down by the following cause.

Figure 6A:
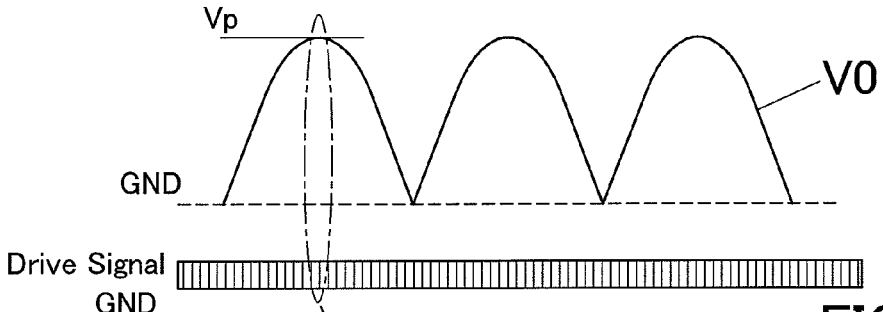
FIG. 6 is a view to explain how a voltage and a current change with the start of driving the switching element, when the rectified input voltage shows a sine wave.
Figure 6B:
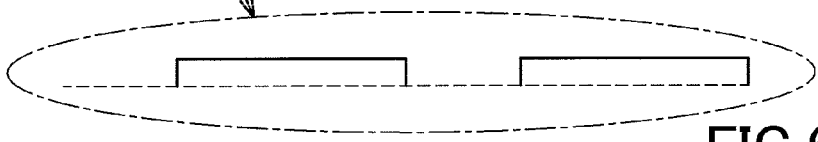
Figure 6C:
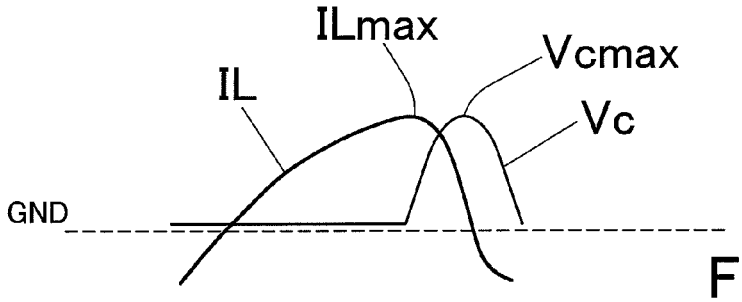

That is, when the input voltage V0 shows a sine wave as illustrated in FIG. 6A, the capacitor 104 starts to be charged through the coil 103 with the falling edge of a pulse produced by a drive signal, which causes the terminal voltage of the switching element 105 rise slowly. FIG. 6B illustrates a pulse produced by a drive signal at the peak of the input voltage V0, and FIG. 6C illustrates a current IL given to the coil 103 and a charging voltage Vc with which to charge the capacitor 104 (a terminal voltage of the switching element 105) at the peak of the input voltage V0.

Defining the peak value of the input voltage V0 as Vp, the maximum value of the current IL and the maximum value of the charging voltage Vc can be expressed using the following formulas: $IL\ max=Vp/(R+\omega L)$ and $Vc\ max=\sqrt{L/C}\times[Vp/(R+\omega L)]^2$, respectively. In these formulas, the symbol R represents a resistance component of the coil 103 and the symbol L represents an inductance of the coil 103.

That is, the maximum value Vcmax of the terminal voltage Vc of the switching element 105 is proportional to a square of the peak value Vp of the input voltage V0.

Figure 7A:
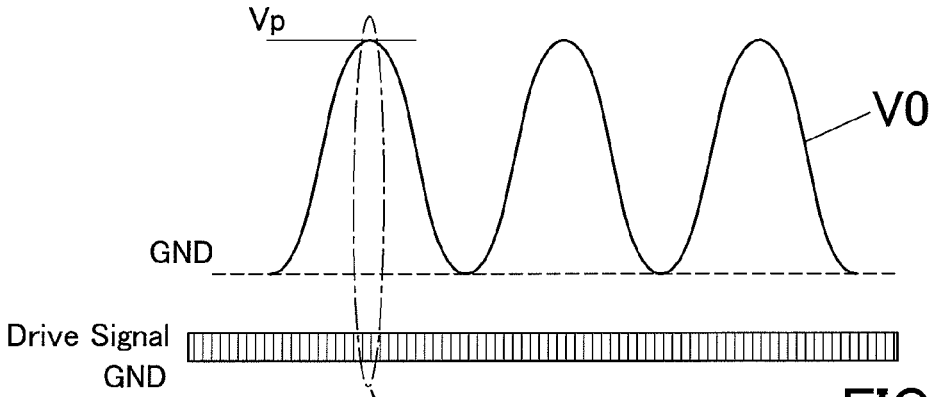
FIG. 7 is a view to explain how a voltage and a current change with the start of driving the switching element, when the rectified input voltage shows a distorted wave.
Figure 7B:
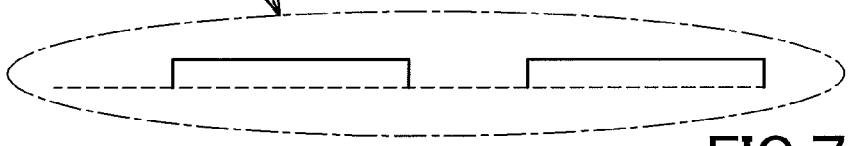
Figure 7C:
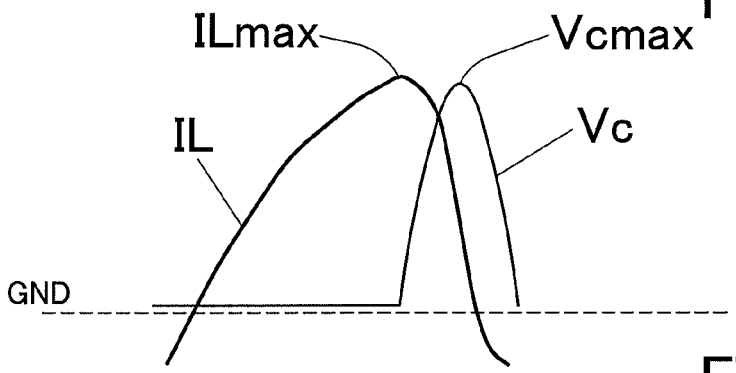

And thus, when the peak value Vp becomes higher with the distortion of the input voltage V0 as illustrated in FIG. 7A, the maximum value Vcmax of the charging voltage Vc also becomes higher as illustrated in FIG. 7C, which is the cause of a breakdown of the switching element 105. FIG. 7B illustrates a pulse produced by a drive signal at the peak of the input voltage V0.

To solve this problem, in this mode of implementation, the constant values A, B, and C are calculated using the following formulas: $A=(\alpha\times Vrms\times\sqrt{2}/CF)+\alpha'$; $B=(\beta\times Vrms\times\sqrt{2}/CF)+\beta'$; and $C=(\gamma\times Vrms\times\sqrt{2}/CF)+\gamma'$, respectively, in order to put them into the above-introduced formula which represents the relationship between the pulse width and the necessary value of power.

In other words, the constant values A, B, and C are calculated based on the ratio of the crest factor $\sqrt{2}$ for a sine-wave input voltage V0 to an actual crest factor calculated by the crest factor calculator 109*a*, which is expressed by the following formula: $\sqrt{2}/CF$, as well as an effective value Vrms of the input voltage V0 which is detected by the effective value detector circuit 108. If the crest factor is higher than that for sine waves, $\sqrt{2}$, because the peak value Vp of the input voltage V0 is high, the constant values A, B, and C will be lower than those for sine waves, causing a smaller pulse width and a lower duty ratio than those for sine waves, respectively. With the decrease of the pulse width, the maximum value ILmax of the current IL to the coil 103 and the maximum value Vcmax of the terminal voltage Vc of the switching element 105 will be both lower, which can reduce the risk for a breakdown of the switching element 15. To the contrary, if the crest factor is lower than that for sine waves, $\sqrt{2}$, because the peak value Vp of the input voltage V0 is low, the pulse width and the duty ratio will be larger and lower, respectively, which allows more input power than conventional method.

Figure 8A:
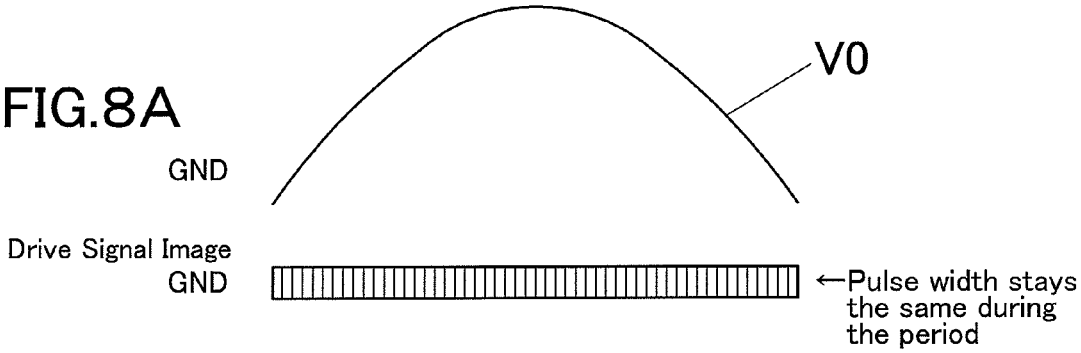
FIG. 8 is a view to explain an example of an operation to control the power to the fuser.

The frequency of a drive signal for the switching element 105 should be arbitrarily set to a constant value from 20 kHz to 100 kHz. From the perspective of simplicity and reliability of control of the switching element 105, it is preferred to adjust the pulse width (duty ratio) to the calculated value at least during a half cycle of an input voltage obtained from an alternating current voltage by rectification, i.e. an arch of the input voltage V0 obtained by rectification, as illustrated in FIG. 8A.

Figure 8B:
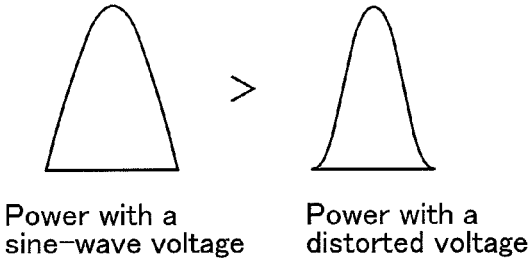

Here, it may seem disadvantageous that the input power with a distorted input voltage is rather less than that with a sine-wave input voltage, as illustrated in the image of FIG. 8B. However, while reducing the risk for a breakdown of the switching element 105 which can be caused when the peak value Vp changes, accurate control of the switching element 105 can be achieved by calculating a pulse width based on an actual effective value of the input voltage and the ratio of the crest factor for a sine-wave input voltage V0 to an actual crest factor.

Hereinafter, another mode of implementing the present invention will be described. In this mode of implementation, accurate control of the switching element 105 can be achieved by changing the pulse width of a half cycle of the input voltage V0 depending on the level of distortion of the input voltage V0.

Figure 9A:
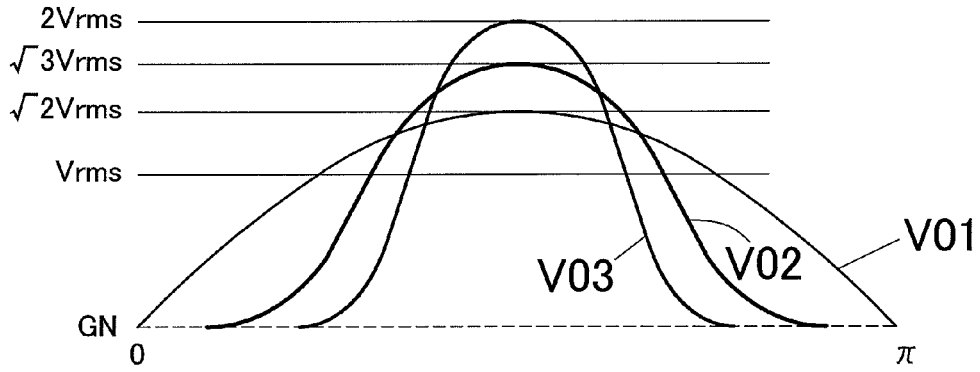
FIG. 9 is a waveform chart to explain a method to estimate the wave that the rectified input voltage shows.

As illustrated in FIG. 9A, the input voltage V0 can be distorted with the deterioration of a power generator, for example. Defining an effective value of the input voltage V0 as Vrms, the input voltage V0, which is formed in the sine wave V01, has a peak value Vp of $\sqrt{2}$Vrms. And in the same Figure, there are distorted waves under the same effective value Vrms: a wave V02 with a peak value Vp of $\sqrt{3}$Vrms and a wave V03 with a peak value Vp of 2Vrms.

Figure 9B:
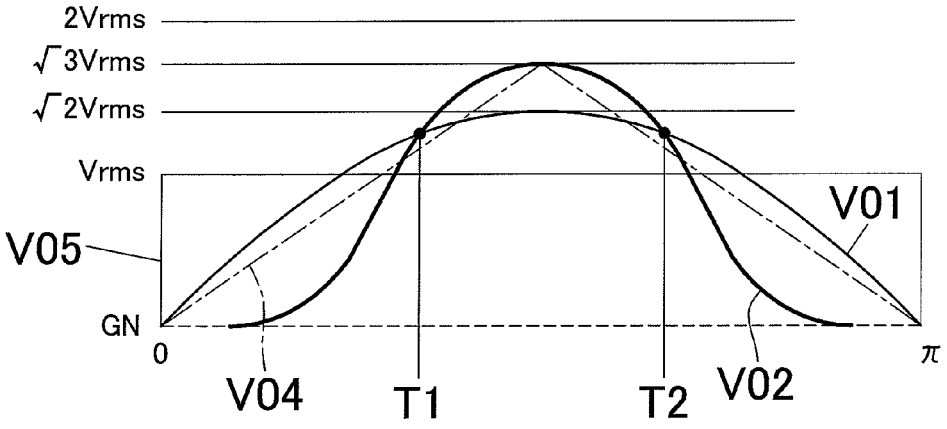

And in FIG. 9B, a triangular wave V04 indicated by an alternating long and short dashed line has a crest factor of $\sqrt{3}$ and a rectangular wave V05 has a crest factor of 1.

Hereinafter, the sine wave V01 with a peak value VP of $\sqrt{2}$Vrms and the distorted wave V02 with a peak value Vp of $\sqrt{3}$Vrms intersect with each other at the time points T1 and T2 (T1<T2) where the higher instantaneous value turns to lower and the reverse also holds true under the same effective value. These time points will be referred to as intersection points.

Figure 10:
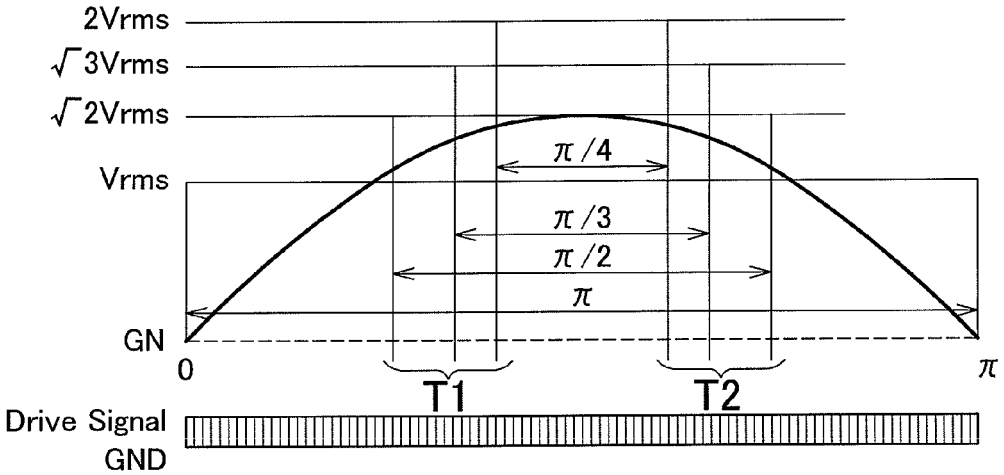
FIG. 10 is a view to explain an interval between the intersection points at which two rectified input voltages in a sine wave and a distorted wave intersect with each other.

While the sine wave V01 is expressed by an angler degree, a half cycle is represented by 0 to π. The intersection points T1 and T2 shared by the sine wave V01 and the distorted wave V02 are usually positioned the same distance away from the peak value Vp of the sine wave V01 and also from the peak value Vp of the distorted wave V02. Defining the position of the peak value Vp of the sine wave V01 as π/2, the distance between the intersection points T1 and T2 on the sine wave V01 can be expressed as $\pi/(CF)^2$. Accordingly, as illustrated in FIG. 10, the distance between the intersection points T1 and T2 on the distorted wave V02 with a peak value of $\sqrt{3}$ can be expressed as π/3, and the distance between the intersection points T1 and T2 on the distorted wave V03 with a peak value of 2Vrms can be expressed as π/4.

In this way as described above, the intersection points T1 and T2 on the input voltage V0 are calculated based on a crest factor, in other words, based on the peak value Vp and the effective value Vrms of the input voltage V0 which are detected by the peak voltage detector circuit 107 and the effective voltage detector circuit 108, respectively.

Figure 11A:
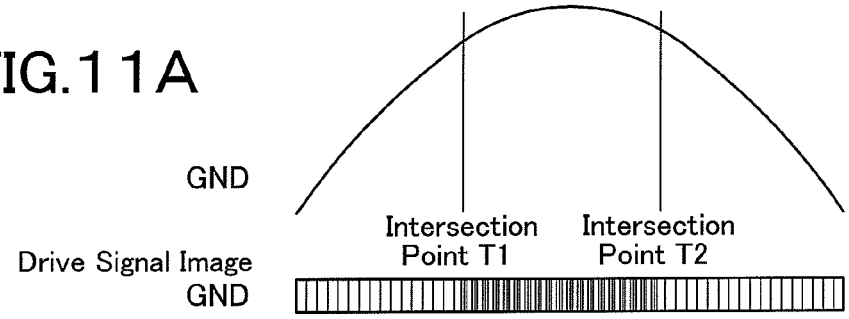
FIG. 11 is a view to explain another example of an operation to control the power to the fuser.

More specifically, under the condition that the intersection points T1 and T2 satisfy T1≤t≤T2, as illustrated in FIG. 11A, it is necessary to calculate the constant values A, B, and C using the above-mentioned formulas: $A=(\alpha\times Vrms\times\sqrt{2}/CF)+\alpha'$; $B=(\beta\times Vrms+\sqrt{2}/CF)+\beta'$; and $C=(\gamma\times Vrms\times\sqrt{2}/CF)+\gamma'$, respectively, in order to put them into the formula representing the relationship between the pulse width and the necessary value of power.

Under the condition that T1>t or t>T2, it is necessary to calculate the constant values A, B, and C using the following formulas: $A=(\alpha\times Vrms\times\sqrt{2}/CF)+\alpha'$; $B=(\beta\times Vrms+\sqrt{2}/CF)+\beta'$; and $C=(\gamma\times Vrms\times\sqrt{2}/CF)+\gamma'$, respectively, in order to put them into the formula representing the relationship between the pulse width and the necessary value of power.

Therefore, under the condition that T1<t<T2, if the crest factor is higher than that for sine waves, $\sqrt{2}$, as illustrated in a drive signal image of FIG. 11A, while the peak value Vp of the input voltage V0 is high, the constant values A, B, and C will be lower than those for sine waves, causing a smaller pulse width and a lower duty ratio than those for sine waves, respectively. Under the condition that T1>t and under the condition that t>T2, the constant values A, B, and C will be higher than those for sine waves, causing a larger pulse width and a higher duty ratio than those for sine waves, respectively.

Figure 11B:
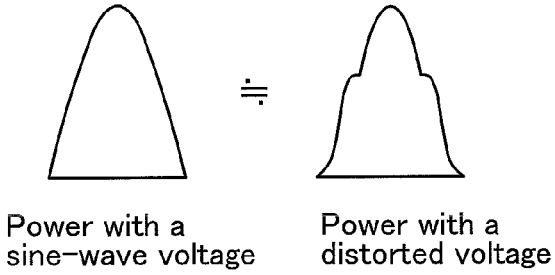

Accurate control of the input power can be achieved by making the difference of duty ratio (pulse width) before and after the intersection points T1 and T2 to adjust the input power for the input voltage V0 to a value approximately identical with power for sine waves, as illustrated in a power image of FIG. 11B.

Here, it may seem disadvantageous that the duty ratio shows an abrupt change before and after the intersection points T1 and T2. In order to solve this, it is necessary to perform control as described below.

Figure 12A:
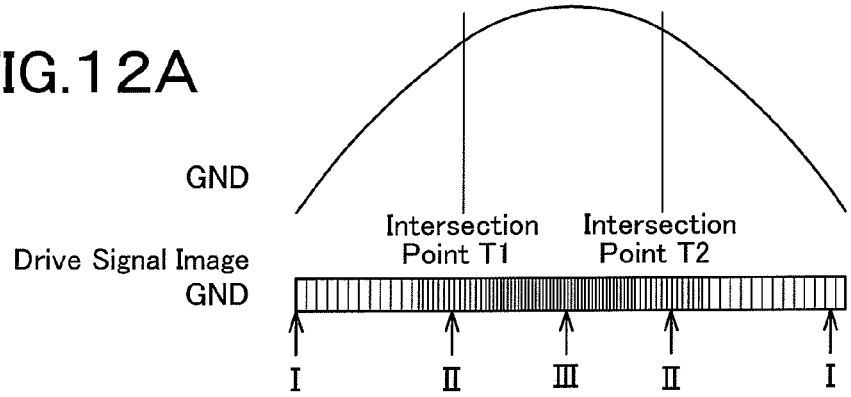
FIG. 12 is a view to explain yet another example of an operation to control the power to the fuser.

That is, as illustrated in FIG. 12A, the period is divided into the following sections: Section I: a period T1>t and a period t>T2 each excluding Section II; Section II: a certain length of period before and after T1 and T2, inclusive; and Section III: a period T1<t<T2 excluding Section II. More specifically, the period starts with Section I, proceeds to Section II, Section III, and Section II again, then ends with Section I. During Section I, the constant values A, B, and C are calculated using the following formulas: $A=(\alpha\times Vrms\times CF/\sqrt{2})+\alpha'$; $B=(\beta\times Vrms\times CF/\sqrt{2})+\beta'$; and $C=(\gamma\times Vrms\times CF/\sqrt{2})+\gamma'$, respectively, in order to put them into the above-introduced formula which represents the relationship between the pulse width and the necessary value of power. During Section II, the constant values A, B, and C are calculated using the following formulas: $A=(\alpha\times Vrms)+\circ'$; $B=(\beta\times Vrms)+\beta'$; and $C=(\gamma\times Vrms)+\gamma'$, respectively, in order to adjust the pulse width to that for sine waves. During Section III, the constant values A, B, and C are calculated using the following formulas: $A=(\alpha\times Vrms\times\sqrt{2}/CF)+\alpha'$; $B=(\beta\times Vrms\times\sqrt{2}/CF)+\beta'$; and $C=(\gamma\times Vrms\times\sqrt{2}/CF)+\gamma'$, respectively, in order to further calculate a pulse width.

Figure 12B:
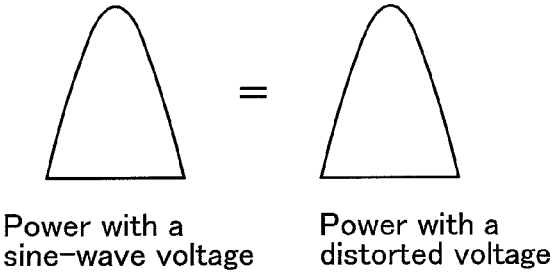

The duty ratio, which shows an abrupt change at the transitions of section: Section I to Section II, Section II to Section III, Section III to Section II, and Section II to Section I, is smoothed out as illustrated in a drive signal image of FIG. 12A, so that the input power for the input voltage V0 can be adjusted to a value approximately identical with the power for sine waves as illustrated in a power image of FIG. 12 B. In this way described above, control of the input power can be performed with more accuracy.

An abrupt change of the pulse width can be smoothed out in some steps according to a CPU or the like, by calculating the number of pulses and a pulse width shown before the intersection points T1 and T2.

It is only necessary to calculate a pulse width using the formulas in the same way as described above even if the input voltage V0 has a crest factor of or lower, because the pulse width simply shows upside down on the axis in that case.

Figure 13:
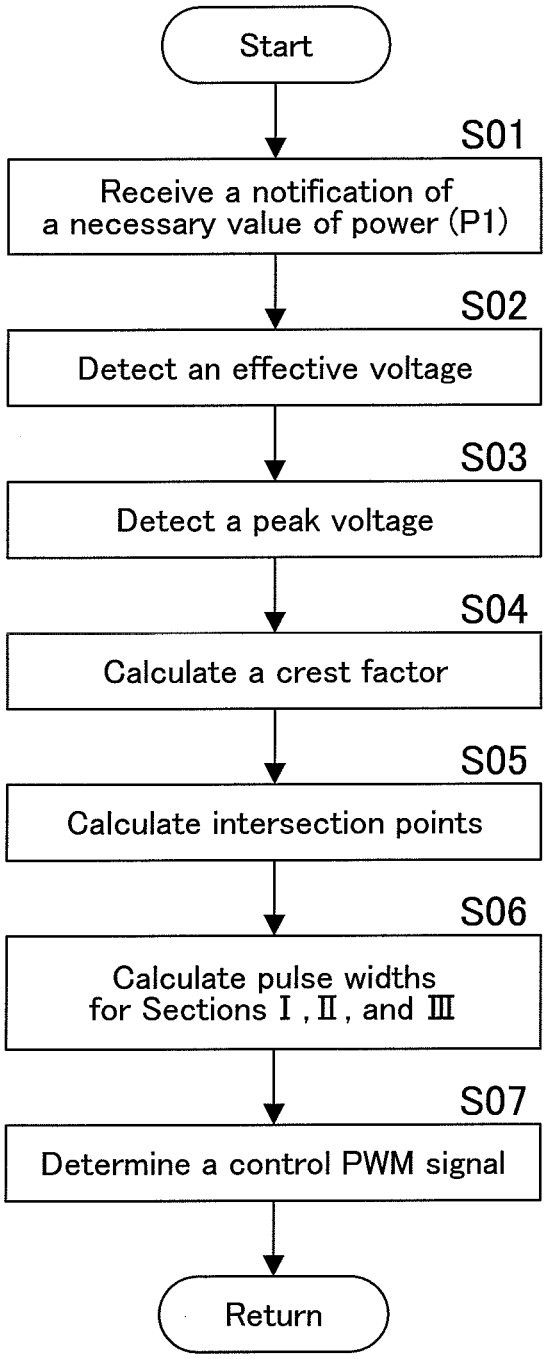
FIG. 13 is a flowchart representing a procedure to determine a drive signal for the switching element, which is performed by a power controller.

FIG. 13 is a flowchart representing a procedure to determine a drive signal for the switching element 105, which is performed by the power controller 109.

In Step S01, a value of power needed to supply the fuser 30 is received from the controller circuit 21 of the image forming apparatus controller 20 of the image forming apparatus 1. And then, an effective value Vrms of the input voltage V0 is detected by the effective voltage detector circuit 108 in Step S02, and a peak value Vp of the input voltage V0 is detected by the peak voltage detector circuit 107 in Step S03.

Subsequently, a crest factor is calculated in Step S04; a intersection points T1 and T2 are calculated in Step S05; pulse widths (duty ratios) for Sections I, II, and III are calculated in Step S06; and a drive signal (control PWM signal) for the switching element 105 is determined in Step S07.

Although the induction heating device 10 includes an effective voltage detector circuit 108 in these modes of implementation described above, a direct current power supplying device of the image forming apparatus 1 commonly includes an effective voltage detector circuit 108 in many cases.

So, the effective voltage detector circuit of the direct current power supplying device may be used as a part of the induction heating device 10.

Figure 14:
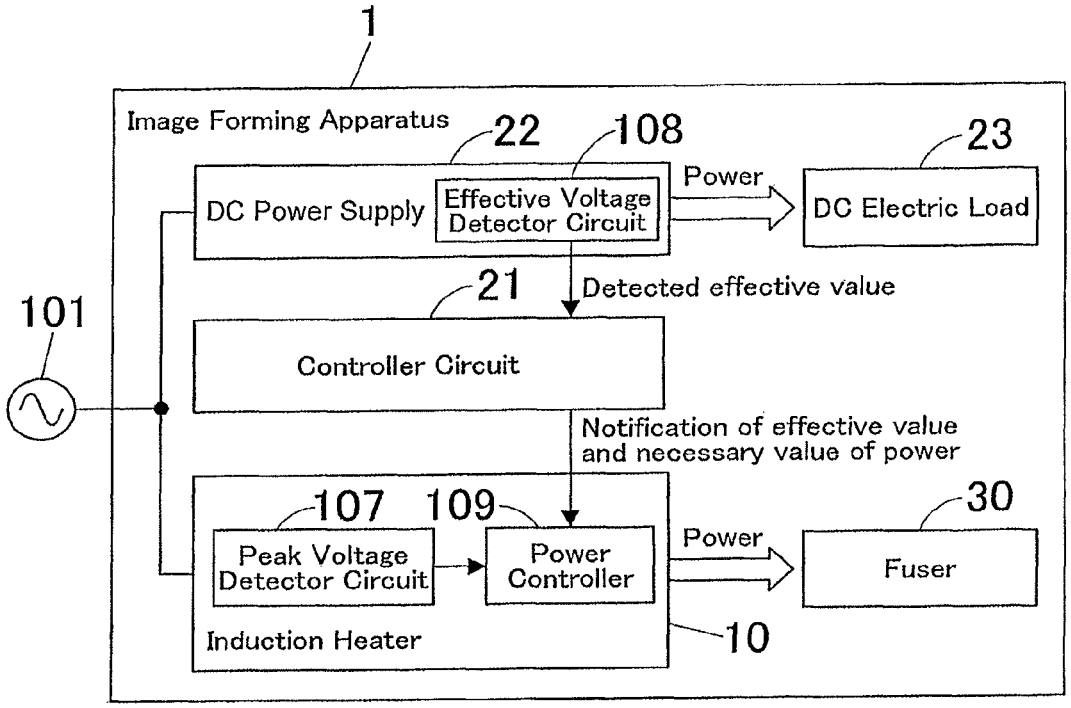
FIG. 14 is a block diagram of an image forming apparatus provided with a direct current power supplying device including an effective voltage detector circuit.

FIG. 14 is a block diagram illustrating a substantial part of the image forming apparatus 1 provided with a direct current power supplying device including an effective voltage detector circuit 108. The image forming apparatus 1 is provided with a direct current power supplying device 22 which rectifies an alternating current voltage from the commercial power supply 101 to supply a direct current electric load 23 of the image forming apparatus 1 with a direct current power. And the direct current power supplying device 22 includes an effective voltage detector circuit 108 which detects an effective value Vrms of the rectified input voltage V0.

Detecting an effective value Vrms, the effective voltage detector circuit 108 inputs the effective value Vrms to the controller circuit 21 of the image forming apparatus controller 20, then the controller circuit 21 transfers the effective value Vrms to the power controller 109 of the induction heating device 10, along with a notification of a value of power needed to supply the fuser 30. The induction heating device 10 calculates a crest factor based on the peak value Vp of the input voltage V0 which is detected by the peak voltage detector circuit 107 of the induction heating device 10 itself and the effective value Vrms received from the controller circuit 21 of the image forming apparatus controller 20, and further calculates a pulse width (duty ratio).

Figure 15A:
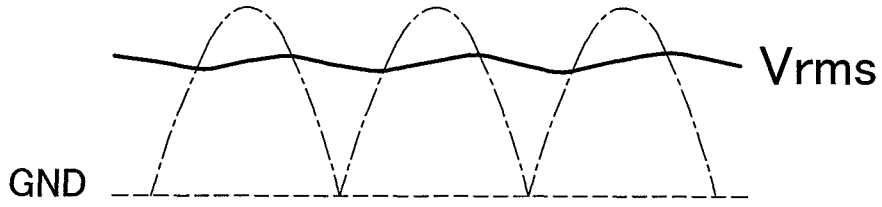
FIG. 15A is a waveform chart to explain that an image forming apparatus is allowed to obtain an effective voltage which usually changes depending on the direct current load on the image forming apparatus itself as shown in FIG. 15B, if being provided with a direct current power supplying device including an effective voltage detector circuit.
Figure 15B:
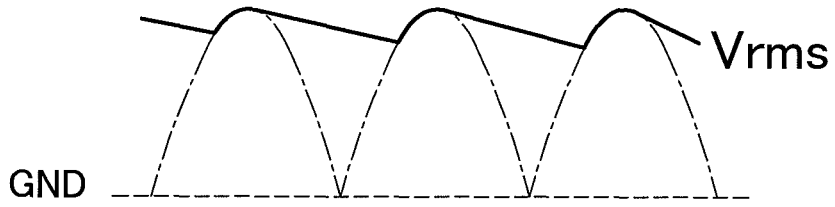

Here, it is preferred that the effective voltage detector circuit 108 of the direct current power supplying device 22 installed on the image forming apparatus 1 detects an effective value Vrms of the rectified voltage when the direct current electric load 23 reaches around its rating as illustrated in FIG. 15A. That is because the effective voltage detector circuit 108 can possibly lose accuracy in detecting an effective value Vrms depending on the load factor.

The present invention of the subject application having been described above may be applied to the following modes.

[1] An induction heating device comprising:

a coil which inductively heats a workpiece of a fuser with an input voltage obtained from an alternating current voltage by rectification;

a switching element coupled in series with the coil;

a peak voltage detector which detects a peak value of the input voltage;

an effective voltage detector which detects an effective value of the input voltage;

a crest factor calculator which calculates an actual crest factor of the input voltage based on the peak value of the input voltage which is detected by the peak voltage detector and the effective value of the input voltage which is detected by the effective voltage detector; and a power controller which achieves control of power to the fuser by controlling the duty ratio of ON and OFF periods of the switching element, wherein the power controller is characterized by calculating a duty ratio of ON and OFF periods of the switching element based on: a value of power needed to supply the fuser; the effective value of the input voltage which is detected by the effective voltage detector; the crest factor for a sine-wave input voltage; and the actual crest factor of the input voltage which is calculated by the crest factor calculator.

[2] The induction heating device as recited in the aforementioned item [1], wherein the power controller calculates a duty ratio of ON and OFF periods of the switching element based on the ratio of the crest factor for a sine-wave input voltage to the actual crest factor of the input voltage which is calculated by the crest factor calculator.

[3] The induction heating device as recited in the aforementioned item [2], wherein: if the actual crest factor of the input voltage which is calculated by the crest factor calculator is higher than the crest factor for a sine-wave input voltage, the power controller makes the duty ratio lower than that which is calculated if it is identical with the crest factor for a sine-wave input voltage; and if the actual crest factor of the input voltage which is detected by the crest factor calculator is lower than the crest factor for a sine-wave input voltage, the power controller makes the duty ratio higher than that which is calculated if it is identical with the crest factor for a sine-wave input voltage.

[4] The induction heating device as recited in any of the aforementioned items [1]-[3], wherein the power controller adjusts the duty ratio to the calculated value, at least during a half cycle of the input voltage obtained from an alternating current voltage by rectification.

[5] The induction heating device as recited in the aforementioned item [2] or [3], wherein there are two points at which a half cycle of the input voltage obtained from an alternating current voltage by rectification and a sine-wave input voltage intersect with each other, and these two points are defined to be T1 and T2 (T1<T2): the power controller calculates a duty ratio based on the ratio of the crest factor for a sine-wave input voltage to the actual crest factor of the input voltage, when the time t satisfies the following formula: T1<t<T2; and the power controller calculates a duty ratio based on the inverse ratio of the crest factor for a sine-wave input voltage to the actual crest factor of the input voltage, when the time t satisfies either of the following formulas: t<T1 and T2<t.

[6] The induction heating device as recited in the aforementioned item [5], wherein for a certain period including the time t satisfying either of the following formulas: t=T1 and t=T2, the power controller adjusts the duty ratio to a value which is calculated if the actual crest factor of the input voltage is identical with the crest factor for a sine-wave input voltage.

[7] The induction heating device as recited in any of the aforementioned items [2]-[6], wherein if a duty ratio of ON and OFF periods of the switching element is calculated based on the ratio of the crest value for a sine-wave input voltage to the actual crest value of the input voltage which is calculated by the crest factor calculator, a pulse width for the duty ratio is further calculated using the following formulas: $PW=A\times W+B$; $A=(\alpha\times Vrms\times\sqrt{2}/CF)+\alpha'$; and $B=(\beta\times Vrms\times\sqrt{2}/CF)+\beta'$ (PW: pulse width; W: necessary value of power; Vrms: effective value of the input voltage; and $\alpha$, $\alpha'$, $\beta$, and $\beta'$: constant values).

[8] The induction heating device as recited in any of the aforementioned items [2]-[6], wherein if a duty ratio of ON and OFF periods of the switching element is calculated based on the ratio of the crest factor for a sine-wave input voltage to the actual crest factor of the input voltage which is calculated by the crest factor calculator, a pulse width for the duty ratio is further calculated using the following formulas: $PW=A\times W^2+B\times W+C$; $A=(\alpha\times Vrms\times\sqrt{2}/CF)+\alpha'$; $B=(\beta\times Vrms\times\sqrt{2}/CF)+\beta'$; and $C=(\gamma\times Vrms\times\sqrt{2}/CF)+\gamma'$ (PW: pulse width; W: necessary value of power; Vrms: effective value of the input voltage; and $\alpha$, $\alpha'$, $\beta$, $\beta'$, $\gamma$, and $\gamma'$: constant values).

[9] An image forming apparatus comprising:

a fuser provided with a workpiece to be heated; and the induction heating device as recited in any of the aforementioned items [1]-[8] to heat the workpiece.

[10] The image forming apparatus as recited in the aforementioned item [9], further comprising a direct current power supplying device which performs rectification on an alternating current voltage to supply each of the parts of the image forming apparatus with a direct current voltage, wherein the direct current power supplying device includes an effective voltage detector which detects an effective value of the input voltage of the induction heating device.

According to the invention as recited in the aforementioned item [1], a duty ratio of ON and OFF periods of the switching element is calculated based on: a value of power needed to supply the fuser; an effective value of the input voltage which is detected by the effective voltage detector; the crest factor for a sine-wave input voltage; and an actual crest factor of the input voltage which is calculated by the crest factor calculator. This process of determining a duty ratio perfectly reflects consideration of the possibility that the input voltage may have a distorted wave instead of a sine wave, making it possible to achieve accurate control of power.

According to the invention as recited in the aforementioned item [2], a duty ratio of ON and OFF periods of the switching element is calculated based on a ratio of the crest factor for a sine-wave input voltage to the actual crest factor of the input voltage which is calculated by the crest factor calculator, making it possible to improve accuracy in controlling power.

According to the invention as recited in the aforementioned item [3], if the actual crest factor of the input voltage is higher than the crest factor for a sine-wave input voltage, the duty ratio is made lower than that which is calculated if it is identical with the crest factor for a sine-wave input voltage; and if the actual crest factor of the input voltage is lower than the crest factor for a sine-wave input voltage, the duty ratio is made higher than that which is calculated if it is identical with the crest factor for a sine-wave input voltage. This process of determining a duty ratio perfectly reflects consideration of the possibility that the input voltage may have a distorted wave, making it possible to achieve accurate control of power.

According to the invention as recited in the aforementioned item [4], the power controller adjusts the duty ratio to the calculated value, at least during a half cycle of the input voltage obtained from an alternating current voltage by rectification, making it easier to control power.

According to the invention as recited in the aforementioned item [5], during a half cycle of the input voltage obtained from an alternating current voltage by rectification, the duty ratio is changed depending on in which phase of the half cycle the present time is. This process of determining a duty ratio perfectly reflects consideration of the possibility that the input voltage may have a distorted wave, making it possible to achieve accurate control of power.

According to the invention as recited in the aforementioned item [6], during a half cycle of the input voltage obtained from an alternating current voltage by rectification, the duty ratio is changed more smoothly depending on in which phase of the half cycle the present time is, making it possible to change a value of input power more smoothly.

According to the invention as recited in the aforementioned item [7], a pulse width for a duty ratio of ON and OFF periods of the switching element can be calculated precisely.

According to the invention as recited in the aforementioned item [8], a pulse width for a duty ratio of ON and OFF periods of the switching element can be calculated precisely.

According to the invention as recited in the aforementioned item [9], the image forming apparatus is allowed to maintain the temperature on the workpiece to a predetermined level so as to deliver high performance in fusing function for its fuser, by supplying the fuser with stable power.

According to the invention as recited in the aforementioned item [10], an effective voltage detector which detects an effective value of the input voltage of the induction heating device is installed on an direct current power source which supplies each of the parts of the image forming apparatus with a direct current voltage, leading to simplification of the configuration of the induction heating device.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to". In this disclosure and during the prosecution of this application, means-plus-function or step-plus-function limitations will only be employed where for a specific claim limitation all of the following conditions are present In that limitation: a) "means for" or "step for" is expressly recited; b) a corresponding function is expressly recited; and c) structure, material or acts that support that structure are not recited. In this disclosure and during the prosecution of this application, the terminology "present invention" or "invention" may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example", and "NB" which means "note well".

What is claimed is:

1. An induction heating device comprising:

a coil which inductively heats a workpiece of a fuser with an input voltage obtained from an alternating current voltage by rectification;

a switching element coupled in series with the coil;

a peak voltage detector which detects a peak value of the input voltage;

an effective voltage detector which detects an effective value of the input voltage;

a crest factor calculator which calculates an actual crest factor of the input voltage based on the peak value of the input voltage which is detected by the peak voltage detector and the effective value of the input voltage which is detected by the effective voltage detector; and a power controller which achieves control of power to the fuser by controlling a duty ratio of ON and OFF periods of the switching element, wherein the power controller calculates the duty ratio of ON and OFF periods of the switching element based on a value of power needed to supply the fuser, the effective value of the input voltage which is detected by the effective voltage detector, a crest factor for a sine-wave input voltage, and the actual crest factor of the input voltage which is calculated by the crest factor calculator, and wherein the power controller calculates the duty ratio of ON and OFF periods of the switching element by using the ratio of the crest factor for a sine-wave input voltage to the actual crest factor of the input voltage which is calculated by the crest factor calculator.

2. The induction heating device as recited in claim 1, wherein: if the actual crest factor of the input voltage which is calculated by the crest factor calculator is higher than the crest factor for a sine-wave input voltage, the power controller makes the duty ratio lower than that which is calculated if it is identical with the crest factor for a sine-wave input voltage; and if the actual crest factor of the input voltage which is detected by the crest factor calculator is lower than the crest factor for a sine-wave input voltage, the power controller makes the duty ratio higher than that which is calculated if it is identical with the crest factor for a sine-wave input voltage.

3. The induction heating device as recited in claim 1, wherein the power controller adjusts the duty ratio to the calculated value of the duty ratio, at least during a half cycle of the input voltage obtained from an alternating current voltage by rectification.

4. The induction heating device as recited in claim 1, wherein there are two points at which a half cycle of the input voltage obtained from an alternating current voltage by rectification and a sine-wave input voltage intersect with each other, and these two points are defined to be T1 and T2 (T1<T2): the power controller calculates a duty ratio based on the ratio of the crest factor for a sine-wave input voltage to the actual crest factor of the input voltage, when a time t satisfies the following formula: $T1 \leq t \leq T2$; and the power controller calculates a duty ratio based on the inverse ratio of the crest factor for a sine-wave input voltage to the actual crest factor of the input voltage, when the time t satisfies either of the following formulas: $t<T1$ and $T2<t$.

5. The induction heating device as recited in claim 4, wherein for a certain period including the time t satisfying either of the following formulas: $t=T1$ and $t=T2$, the power controller adjusts the duty ratio to a value which is calculated if the actual crest factor of the input voltage is identical with the crest factor for a sine-wave input voltage.

6. The induction heating device as recited in claim 1, wherein if a duty ratio of ON and OFF periods of the switching element is calculated based on the ratio of the crest value for a sine-wave input voltage to the actual crest value of the input voltage which is calculated by the crest factor calculator, a pulse width for the duty ratio is further calculated using the following formulas: $PW=A\times W+B$; $A=(\alpha\times Vrms\times\sqrt{2}/CF)+\alpha'$; and $B=(\beta\times Vrms\times\sqrt{2}/CF)+\beta'$ (PW: pulse width; W: necessary value of power; Vrms: effective value of the input voltage; $\alpha$, $\alpha'$, $\beta$, and $\beta'$; constant values, and $CF=Vp/Vrms$ wherein Vp is the peak value of the input voltage).

7. The induction heating device as recited in claim 1, wherein if a duty ratio of ON and OFF periods of the switching element is calculated based on the ratio of the crest factor for a sine-wave input voltage to the actual crest factor of the input voltage which is calculated by the crest factor calculator, a pulse width for the duty ratio is further calculated using the following formulas: $PW=A\times W^2+B\times W+C$; $A=(\alpha\times Vrms\times\sqrt{2}/CF)+\alpha'$; $B=(\beta\times Vrms\times\sqrt{2}/CF)+\beta'$; and $C=(\gamma\times Vrms\times\sqrt{2}/CF)+\beta'$ (PW: pulse width; W: necessary value of power; Vrms: effective value of the input voltage; $\alpha$, $\alpha'$, $\beta$, and $\beta'$; constant values, and $CF=Vp/Vrms$ wherein Vp is the peak value of the input voltage).

8. An image forming apparatus comprising:

a fuser provided with a workpiece to be heated;

the induction heating device as recited in claim 1 to heat the workpiece; and a direct current power supplying device which performs rectification on an alternating current voltage to supply each of parts of the image forming apparatus with a direct current voltage, wherein the direct current power supplying device includes an effective voltage detector which detects an effective value of the input voltage of the induction heating device.

* * * * *